US005377636A

United States Patent [19]

Rix et al.

[11] Patent Number: 5,377,636

[45] Date of Patent: Jan. 3, 1995

[54] SOLENOID OPERATED PUMP-LINE-NOZZLE FUEL INJECTION SYSTEM AND INLINE PUMP THEREFOR

[75] Inventors: David M. Rix; Harry L. Wilson; Rodney C. Wilson; George L. Muntean, all of Columbus, Ind.

[73] Assignee: Cummins Engine Company, Inc., Columbus, Ind.

[21] Appl. No.: 102,830

[22] Filed: Aug. 6, 1993

[51] Int. Cl.[6] ..... F02M 37/04; F02M 7/00

[52] U.S. Cl. ..... 123/446; 123/500; 123/506

[58] Field of Search ..... 123/446, 500, 501, 506

[56] References Cited

U.S. PATENT DOCUMENTS

| | | | |
|---|---|---|---|
| 2,947,257 | 8/1960 | Bessiere . | |
| 2,950,709 | 8/1960 | Bessiere . | |
| 3,035,523 | 5/1962 | Kemp et al. . | |
| 4,378,774 | 4/1983 | Kato | 123/446 |
| 4,385,609 | 5/1983 | Kato et al. | 123/446 |
| 4,396,151 | 8/1983 | Kato et al. | 123/446 |
| 4,402,456 | 9/1983 | Schneider | 123/446 |
| 4,502,445 | 3/1985 | Roca-Nierga et al. | 123/458 |
| 4,503,825 | 3/1985 | Schneider | 123/446 |
| 4,531,672 | 7/1985 | Smith | 239/89 |
| 4,538,576 | 9/1985 | Scheider | 123/446 |
| 4,601,269 | 7/1986 | Kato et al. | 123/446 |
| 4,621,605 | 11/1986 | Carey, Jr. et al. | 123/446 |
| 4,759,330 | 7/1988 | Kato et al. | 123/446 |
| 4,951,631 | 8/1990 | Eckert | 123/446 |
| 5,040,511 | 8/1991 | Eckert | 123/446 |
| 5,072,709 | 12/1991 | Long et al. | 123/446 |

FOREIGN PATENT DOCUMENTS

| | | |
|---|---|---|
| 442839 | 11/1934 | United Kingdom . |
| 1306422 | 2/1973 | United Kingdom . |

OTHER PUBLICATIONS

SAE publication no. SP-703, *Recent Developments in Electronic Engine Control & Fuel Injection Management*, paper nos. 870433, 870434 and 870436, pp. 37–42, 43–51 & 65–77, Feb. 1987.

*Primary Examiner*—Raymond A. Nelli
*Assistant Examiner*—Thomas N. Moulis
*Attorney, Agent, or Firm*—Sixbey, Friedman, Leedom & Ferguson

[57] ABSTRACT

A pump-line-nozzle fuel injection system in which a supply pump is coupled to a high pressure pump having a plurality of pumping cylinders, each of which has a cam-driven timing plunger and a floating metering plunger. During the retraction stroke, flow to a timing chamber formed between the pistons is blocked by a solenoid valve while the fuel passes into a metering chamber, at the discharge side of the pump, which is closed relative to the high pressure delivery line by a delivery valve. Once the proper quantity of fuel has been metered, the solenoid valve opens allowing fuel to flow into the metering chamber, balancing the pressure on opposite sides of the metering piston, so as to prevent the metering plunger from retracting further as the timing plunger continues to retract. During the compression stroke, at the appropriate time for commencement of injection, the solenoid valve recloses creating a hydraulic link between the metering and timing plungers, so that the fuel is pressurized. Once the fuel is sufficiently pressurized, the delivery valve opens and the fuel is delivered to the injector via the high pressure delivery line. Each pumping cylinder delivers fuel to a respective associated injector for each cylinder of the engine. Compressibility of the fuel and the length of the high pressure delivery line is compensated for by an electronic control module and by making the timing plunger of a larger diameter than the metering plunger so as to obtain a fast pumping rate.

16 Claims, 5 Drawing Sheets

SOLENOID OPERATED PUMP-LINE-NOZZLE FUEL INJECTION SYSTEM AND INLINE PUMP THEREFOR

BACKGROUND OF THE INVENTION

1. Field of the Invention

The present invention relates to solenoid operated pump-line-nozzle fuel injections systems for internal combustion engines. In particular, to such fuel injection systems in which an inline injection pump utilizes a solenoid-operated control for regulating injection timing and the quantity of fuel injected.

2. Description of Related Art

Inline injection pumps and pump-line-nozzle fuel injections systems using such pumps are old and well known. A discussion of several examples of such pumps and systems, and the efforts taken to improve their construction so that the increasing demands for low exhaust emissions can be met, can be found, for example, in SAE publication no. SP-703, *Recent Developments in Electronic Engine Control & Fuel Injection Management,* paper Nos. 870433, 870434 and 870436, pages 37–42, 43–51 and 65–77 published February, 1987. Inline pumps have a separate pumping cylinder for supplying fuel to each injection nozzle of the injection system, to which it is connected by a fuel line (hence, the name pump-line-nozzle injection system), a respective injection nozzle being provided for each engine cylinder. While inline pumps, such as those described in the papers cited above, are able to independently control injection timing and injection quantity, none of the known inline pumps produces individual cylinder control of both timing and fuel quantity on an infinitely adjustable basis; that is, typically such pumps having a control rack which adjusts all pumping cylinders in the same manner at the same time, and frequently using a step-wise adjusting driver.

Another type of pump used in pump-line-nozzle systems is a distributor pump. Examples of such pumps can be found in U.K. Patent Nos. 442,839 and 1,306,422 as well as U.S. Pat. Nos. 3,035,523 and 4,502,445, and a system and component description of both inline and distributor pumps can be found at page 24 of the above-cited SAE publication SP-703 in paper no. 870432 as well. In distributor pumps, only a single pumping cylinder is provided and a rotary distributor determines which injection nozzle will receive a specific dose of fuel. Inherently, such pumps cannot provide individual cylinder control since they lack individual pumping cylinders to control; however, as indicated, e.g., in U.S. Pat. Nos. 2,947,257 and 2,950,709, such distributor pumps can be constructed as multicylinder pumps as well (but in such a case they essentially become inline pumps, with a rack, cam or other single regulating mechanism being used to control "the whole of the injectors" and to insure that fuel delivery "is the same for all the cylinders"), so that individual cylinder control is still not obtained.

Another type of fuel injection system, which is fundamentally different from pump-line-nozzle systems, is the unit injector fuel injection system. In such a system, a positive displacement pump is used to supply fuel at low pressure, typically at constant pressure of e.g., 30 psi, to a respective unit fuel injector associated with each engine cylinder. The unit injectors, themselves, regulate the timing and metering of the fuel into the respective engine cylinder and also develop the high pressure, e.g., at least 15,000 psi at which the fuel needs to be injected into the engine cycle if the requirements for increased fuel economy and decreased emissions are to be achieved.

Solenoid operated fuel injectors of the unit injector type having characteristics of the type sought to be obtained with the inline pump of the pump-line-nozzle injector system of the present invention have been in use for some time, and an example of such an injector can be found in commonly-owned U.S. Pat. No. 4,531,672 to Smith. In this type of injector, a timing chamber is defined between a pair of plungers that are reciprocatingly displaceable within the bore of the body of the injector and a metering chamber is formed in the bore below the lower of the two plungers. A supply rail in the engine delivers a low pressure supply of fuel to the injector body. To control this supply of fuel, a solenoid valve is disposed in the flow path between the fuel supply rail and the injector bore and the plungers block and unblock respective ports leading from injector body fuel supply circuit into the timing and metering chambers.

During the operation of such an injector, the port to the timing chamber is opened during retraction of the plungers to allow fuel to enter the timing chamber. During the injector downstroke, the timing port is closed by the upper plunger, and then, the metering port is opened to direct the supply of fuel into the metering chamber. During the entire time, from the start of the timing period through the end of the metering period, the solenoid valve remains open.

In an existing unit injector design, sold by the Cummins Engine Co. under the CELECT trademark, shown in FIGS. 1–3, improved performance is achieved. In this existing unit fuel injector 1, as shown in FIG. 1, initially, during the retraction stroke, with the solenoid valve 3 closed, the metering plunger 5 and the timing plunger 7 rise together, and fuel under rail pressure is metered into the metering chamber 9. When the proper quantity of fuel has been metered, the solenoid valve 3 is opened (FIG. 2), allowing fuel to flow into the timing chamber 11, causing the pressure at the top and bottom of the metering plunger to be equalized, thereby stopping movement of the metering plunger 5 while the timing plunger 7 continues to rise, and the timing chamber 11 to fill, as the retraction stroke is completed.

During the downstroke, prior to the time at which injection is to commence, as shown in FIG. 3, the solenoid valve 3 remains open and fuel is forced back out of the timing chamber 11, through the solenoid valve 3 into supply circuit. A relief valve assembly 15 is provided to vent high pressure spikes from the rail side of the injector 1 to the drain side thereof (enlarged detail of FIG. 3). More specifically, the relief valve assembly 15 comprises a valve member **15*a* which is urged against a relief port 15*b* by a coil spring 15*c* which is disposed in a barrel member 17, the upper surface of which forms the bottom wall of the metering chamber 9 and which contains channels through which fuel flows between the fuel inlet port and the metering chamber and from the metering chamber to a drain passage 21. When the pressure of the backflowing timing fluid exceeds that of spring 15*c*, the valve member 15*a* unblocks relief port 15*b*, thereby opening a path from the fuel supply circuit to drain passage 21. At the end of the injection phase, when the solenoid 3 is closed, the top edge of the metering plunger 5 passes below at least one timing fluid spill port 23, thereby evacuating the timing chamber 11 via the drain passage 21. Additionally, passages 5***a* in the metering plunger 5 are brought into communication with at least one spill port 25 by which a small quantity of fuel is spilled to the fuel supply circuit. Then, the described cycle of events is repeated.

However, while unit fuel injector fuel injection systems are available by which the amount of fuel injected and timing of its injection can be independently and infinitely adjusted on a individual cylinder and cycle-to-cycle basis, using a relatively simple, single solenoid control for each injector, unit injectors, due to increased tasks associated therewith in comparison to the injection nozzle of a pump-line-nozzle injection system, is relatively large in comparison to the injection nozzle of pump-line-nozzle injection systems. As a result, the use of unit fuel injector system has been confined to large, heavy duty engines since insufficient space exists in the engine valve area of smaller engines to accommodate unit fuel injectors. Thus, there still is a need for further improvements to pump-line-nozzle fuel injector systems of the: type to which this invention is directed, in order to provide the degrees of precision control needed to meet the competing demands for both increased fuel economy and decreased engine exhaust emissions.

SUMMARY OF THE INVENTION

In view of the foregoing, it is an object of the present invention to pump-line-nozzle fuel injector system in which an inline injection pump utilizes a solenoid-operated control for regulating injection timing and the quantity of fuel injected so as to enable the amount of fuel injected and timing of its injection to be independently and infinitely adjusted on a individual cylinder and cycle-to-cycle basis.

In connection with the preceding object, it is a more specific object to adapt known unit fuel injector technology to the environment of pump-line-nozzle systems where the compressibility of the fuel has a significant effect due to the length of the line between the pump and the nozzle.

A still further object is to provide an inline pump in which a solenoid valve controls both metering and timing by making and breaking a hydraulic link between a metering plunger and a timing plunger of the injection pump.

These and other objects are achieved in accordance with a preferred embodiment of the invention in which a supply pump is coupled to a high pressure pump having a plurality of pumping cylinders, each of which has a cam-driven timing plunger and a floating metering plunger. During the retraction stroke, flow to a timing chamber formed between the pistons is blocked by a solenoid valve while the fuel passes a check valve into a metering chamber at the discharge side of the pump, which is closed relative to a high pressure delivery line by a delivery valve. Once the proper quantity of fuel has been metered, the solenoid valve opens allowing fuel to flow into the metering chamber, balancing the pressure on opposite sides of the metering piston, so as to prevent the metering plunger from retracting further as the timing plunger continues to retract. During the compression stroke, at the appropriate time for commencement of injection, the solenoid valve recloses creating a hydraulic link between the metering and timing plungers so that the fuel is pressurized. Once the fuel is sufficiently pressurized, the delivery valve opens and the fuel is delivered to the injector via the high pressure delivery line. Each pumping cylinder delivers fuel to a respective associated injector for each cylinder of the engine. Compressibility of the fuel and the length of the high pressure delivery line is compensated for by an electronic control module and by making the timing plunger of a larger diameter than the metering plunger so as to obtain a fast pumping rate.

These and further objects, features and advantages of the present invention will become apparent from the following description when taken in connection with the accompanying drawings which, for purposes of illustration only, show a preferred embodiment in accordance with the present invention.

DETAILED DESCRIPTION OF THE PREFERRED EMBODIMENT

Figure 1:
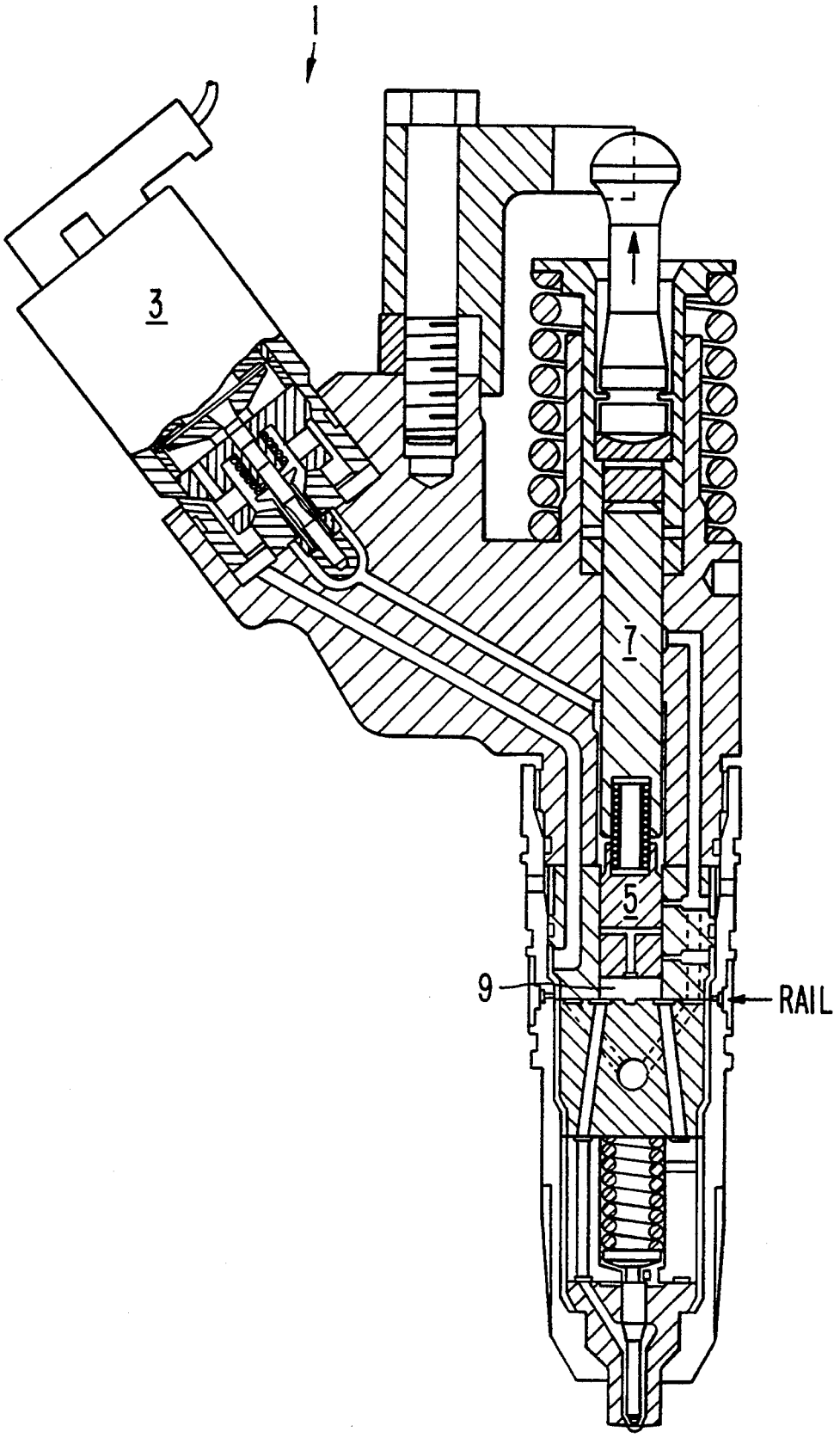
FIG. 1 (PRIOR ART)
FIG. 1 is schematic cross-sectional depiction of an existing unit fuel injector during a metering phase.
Figure 2:
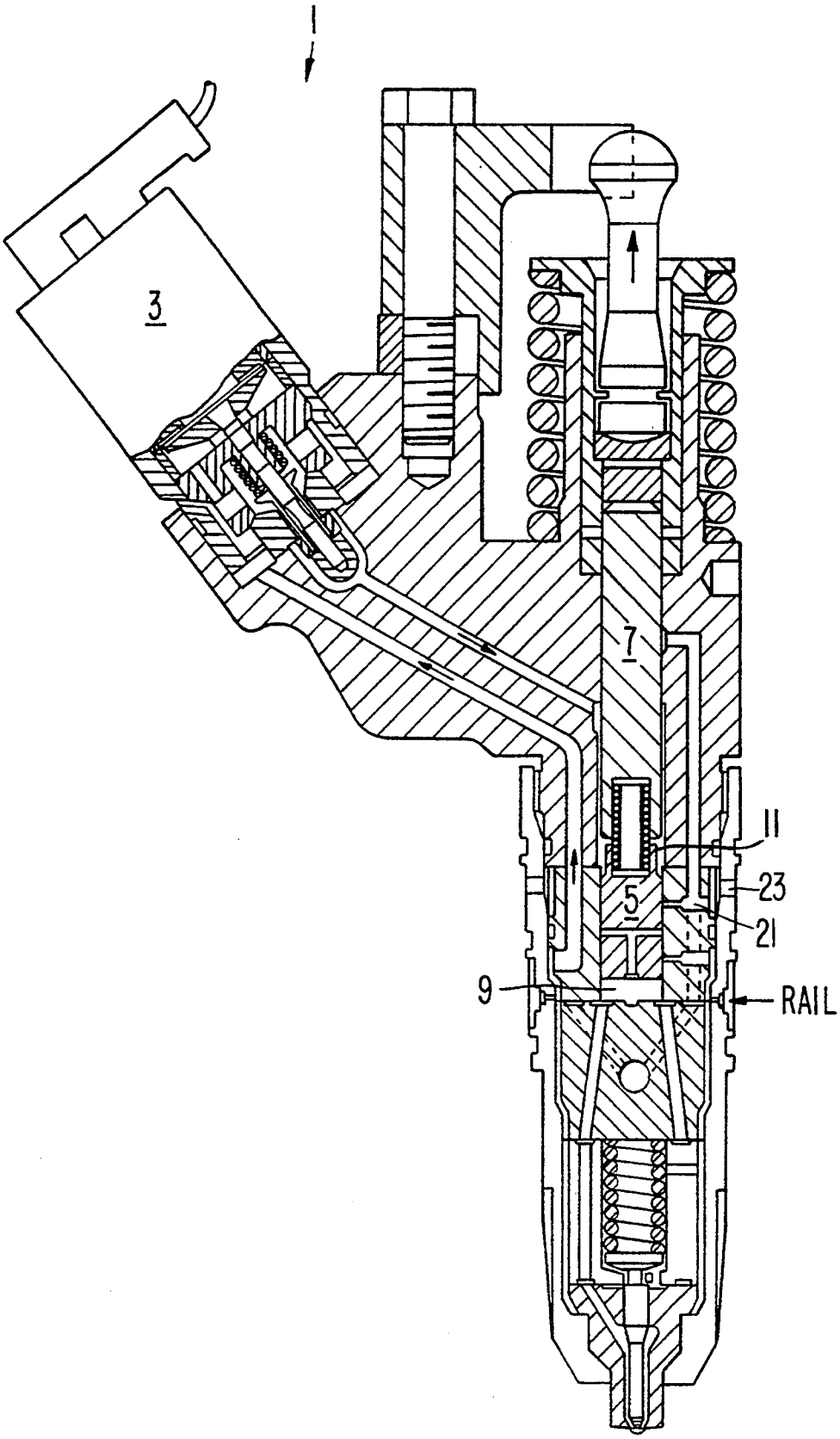
FIG. 2 (PRIOR ART)
FIG. 2 is schematic cross-sectional depiction of the FIG. 1 fuel injector during a timing chamber filling phase.
Figure 3:
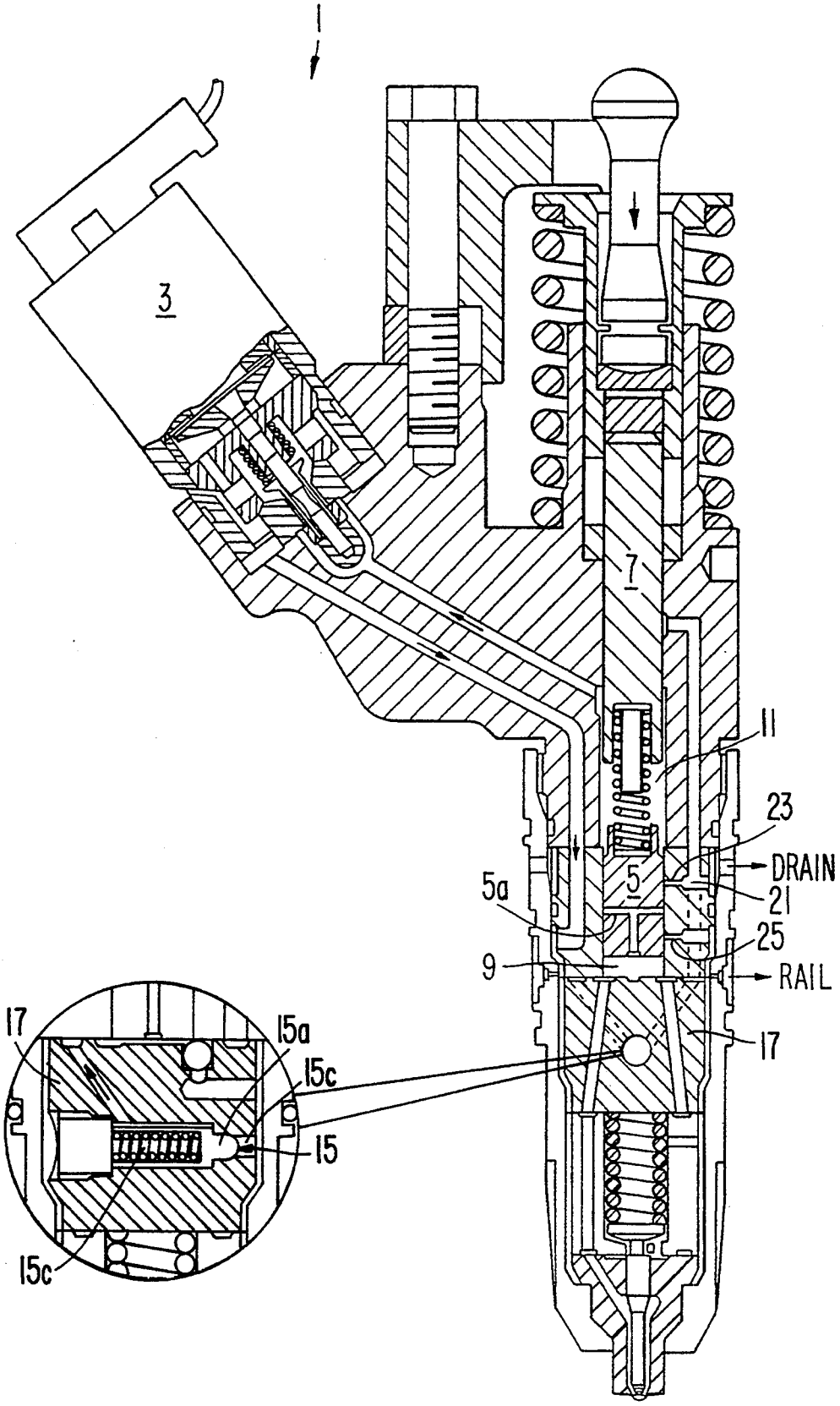
FIG. 3 (PRIOR ART)
FIG. 3 is schematic cross-sectional depiction of the FIG. 1 fuel injector during a timing phase.
Figure 4:
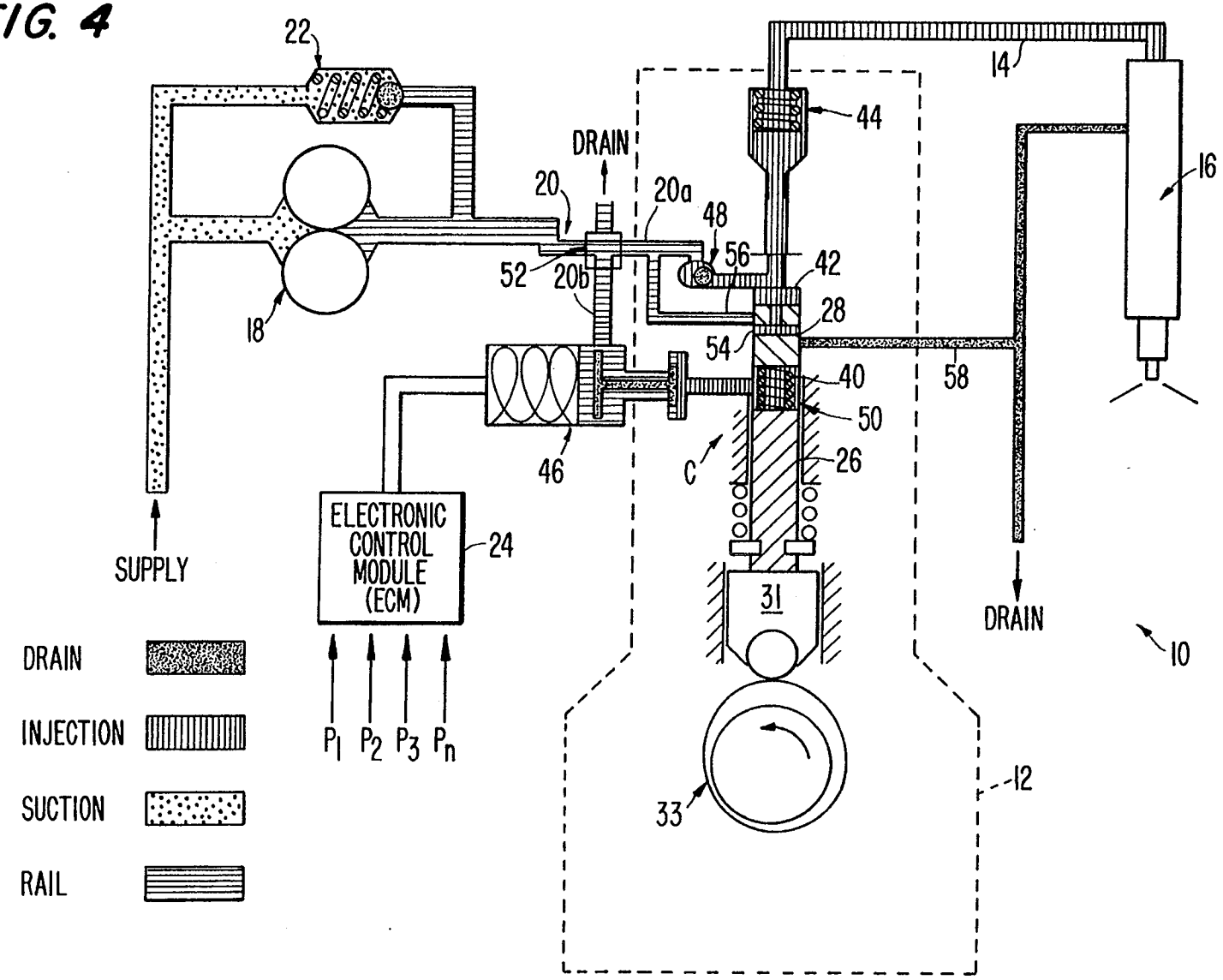
FIG. 4 is a schematic diagram of a pump-line-nozzle fuel injection system in accordance with the present invention.

With reference to FIG. 4, the preferred embodiment pump-line-nozzle fuel injection system 10 in accordance with the present invention can be seen to be comprised of an inline high pressure pump 12 having a plurality of identical pumping cylinder units C (only one of which is shown), each of which is connected a high pressure line 14 to a respective one of a plurality of engine fuel injectors 16 (only one of which is shown), and corresponding in number to the number of cylinders of the internal combustion engine with which it is to be used (not shown). A low pressure supply pump 18 draws fuel from a fuel supply (such as a vehicle fuel tank) and to each of the pumping cylinder units C of inline pump 12, via a fuel supply circuit 20, at a pressure of, e.g., about 30 psi, which is held substantially constant by a pressure regulator 22.

Since the construction and operation of all of the pumping cylinder units C of inline pump 12 are identical, for simplicity, only the single pumping cylinder unit C shown will be described in detail, it being understood that such descriptions are not limited to only that one cylinder unit. On the other hand, it should be realized that each of the several pumping cylinder units of pump 12 is independently, individually controllable with respect to the timing and quantity of fuel caused to be injected thereby under the control of the Electronic Control Module (ECM) 24, as will be explained further below.

As illustrated, each pumping cylinder unit C comprises a timing plunger 26 and a metering plunger 28 that are reciprocatingly received in a bore of the pump 12. The timing plunger 26 is spring-loaded against a tappet 31 which rides on the periphery of a respective lobe of a pump cam shaft 33, pump cam shaft 33 being linked to the engine drive shaft to rotate in synchronism therewith. In view of the high pressures generated by the pumping unit C, e.g., approximately 15,000–18,500 psi, to at least partially compensate for the length of high pressure line 14 and the compressibility of the fuel therein, timing plunger 26 is, preferably, larger in diameter, about one-third larger, than the metering plunger 28 so as to achieve a fast pumping rate. For example, it has been found to be suitable to use a timing plunger of 12 mm diameter with a metering plunger of 9 mm.

A variable volume timing chamber 40 is defined in the bore of the pumping cylinder between the timing plunger 26 and a facing end of the metering plunger 28, and a metering chamber 42 is defined between the opposite end of the metering plunger and a delivery valve 44. The flow of timing fluid (which may be engine lubrication oil, or fuel as illustrated) into and out of the timing chamber is controlled by a solenoid valve 46, and return flow out of the metering chamber 42 is prevented by a metering check valve 48.

During the retraction stroke of timing plunger 26, initially, metering plunger 28 is drawn down with it and fuel flows into the metering chamber from a respective branch 20*a* of the fuel supply circuit 20. At the same time, solenoid valve 46 prevents timing fluid from flowing into timing chamber 40. When the ECM 24 determines that the appropriate quantity of fuel has been metered, it causes solenoid valve 46 to open. This starts the flow of timing fluid, in this case fuel via a timing fluid flow branch 20*b* of fuel supply circuit 20, into the timing chamber 40. This also has the effect of balancing the pressures at the opposite sides of the metering piston 28, so that it stops moving and floats relative to timing plunger which continues to move downward as it follow the cam 33. Furthermore, to insure that the metering plunger is held stationary and to prevent return flow leakage through the check valve 48, a spring 50 acts between the facing ends of the timing and metering plungers in order to prevent the metering plunger from drifting downward and to maintain enough pressure on the fuel in the metering chamber 42 to close the check valve 48. In this way, a precisely metered quantity of fuel to be injected is trapped in the metering chamber 42 once solenoid valve 46 opens and the timing chamber 40 fills with timing fluid (fuel).

As the tappet 31 continues to track the curvature of the lobe of cam 33, at the end of the retraction stroke, the timing plunger is caused to move in its compression stroke toward the metering piston and the discharge end of the pumping cylinder. However, until the ECM 24 determines that the appropriate time for commencement of injection has arrived, solenoid valve 46 remains open and the fuel is forced back out of the timing chamber 40, through the solenoid valve 46 to the supply circuit 20. To prevent this outflow of fuel from affecting the supply of fuel to travel to other pumping cylinder units via their supply branches 20*a*, a relief valve can be provided to vent high pressure spikes from the supply side of the system 10 to the drain side thereof, such a relief valve being schematically depicted by block 52 at the manifold junction from which the branches 20*a*, 20*b* extend; however, it will be appreciated that the relief valve 52 can be placed at any of a number of other locations instead.

Once the ECM 24 determines that the appropriate time for initiation of injection has arrived, it triggers closing of solenoid valve 46, thereby trapping the remainder of the fuel serving as the timing fluid in the timing chamber 40. This trapped fuel acts as a hydraulic link between the timing plunger 26 and the metering plunger 28, and thus, causing the upward force on the timing plunger 26 to be transferred to the metering plunger 28, pressurizing the fuel in the metering chamber 42. When the pressure of the fuel in the metering chamber 42 reaches the required level, the delivery valve 44 pops open, allowing the fuel to flow from the metering chamber 42 into the high pressure line 14 and into the injector 16. Because the nozzle spray holes are closed by a needle valve of injector 16, continued upward movement of the plungers 26, 28, opening pressure is reached, the fuel causes the needle valve in the nozzle of injector 16 to open, so that the fuel exits spray holes of the nozzle into the combustion chamber of the engine. However, since the nozzle holes form a flow restriction, the fuel pressure will steadily increase, e.g. 15,000–18,500 psi as injection progresses and the plungers 26, 28 are driven further into the cylinder bore by the action of the tappet 31 and cam 33.

Injection is terminated when a T-shaped spill passage 54 in the metering piston 28 is brought into communication with a spill line 56, at which point the pressure in the metering chamber drops rapidly as the remaining fuel is spilled therefrom, thereby allowing the needle valve in injector 16 to close abruptly. The delivery valve 44 also closes and is designed to control line dynamics in high pressure line 14 so as to prevent secondary injection and insure a positive end to fuel injection. Immediately after the metering spill passage 54 reaches spill line 56, the end of the metering plunger 28, bounding the timing chamber 40, clears a drain port to drain line 58, spilling the timing fluid from the timing chamber 40 to drain as the tinting plunger completes its inward movement, thus, completing the injection cycle.

Figure 5:
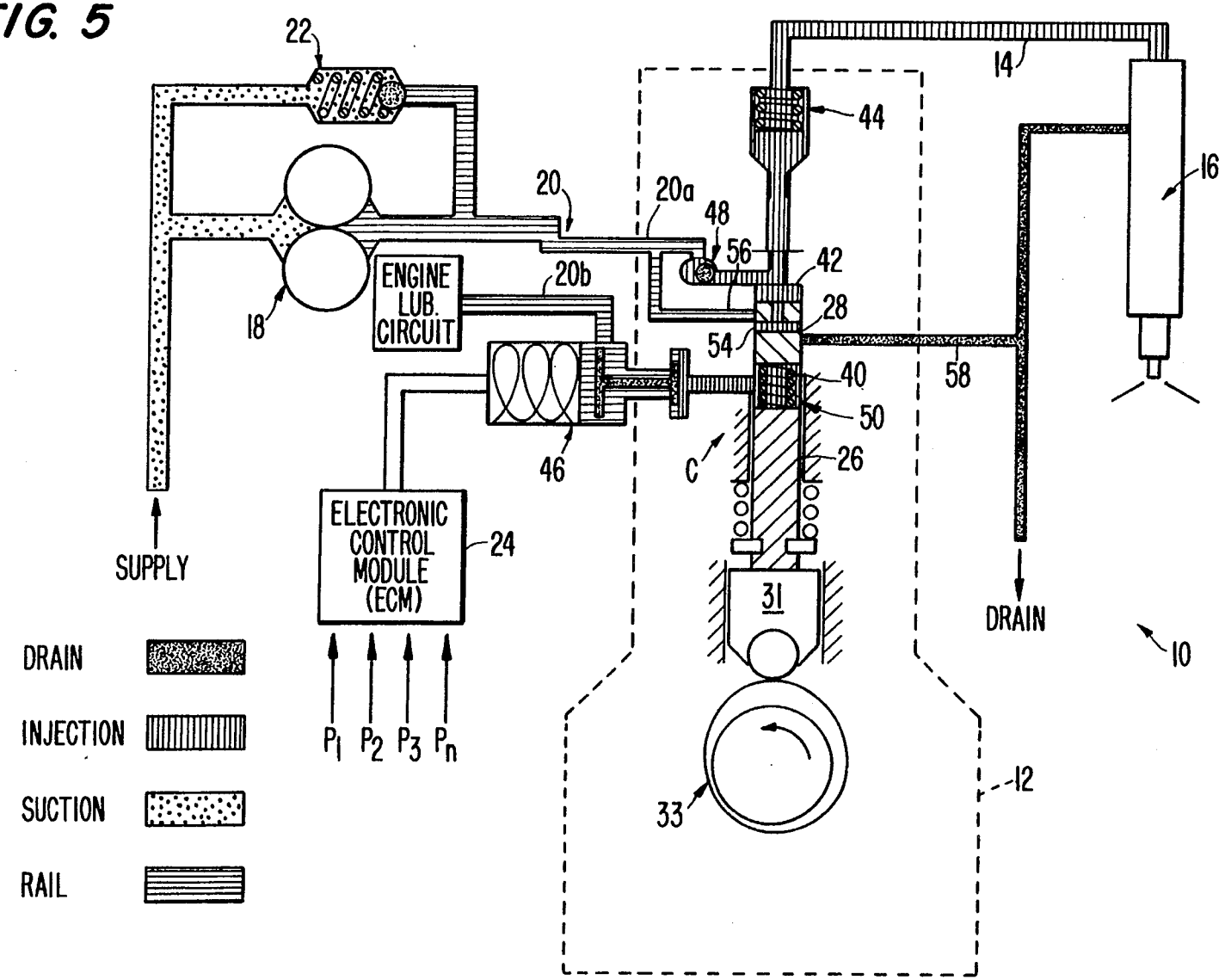
FIG. 5 is a schematic diagram as in FIG. 4, but of a modified embodiment.

The ECM 24 can be of conventional design receiving various engine operating parameter inputs $P_1, P_2 \ldots P_n$, such as engine speed, load, etc. and determining the appropriate times for opening and closing the solenoid valves 46 on the basis thereof and can also adjust for the compressibility of the fuel and the length of high pressure lines 14. Due to similarities between the present invention and the above-noted CELECT unit injector, the present invention can share such components as the ECM, sensors and solenoid valve, and will enable service tools used with that unit injector for calibration and problem diagnosis to be used with the pump-line-nozzle system of this invention, thereby increasing its cost effectiveness. Also, the present invention can be implemented on existing engines without redesign of the engine head or block. Likewise, no significant changes from the system and operation described above are needed to implement the mentioned ability to use lubrication oil as the timing fluid instead of fuel; that is, tinting fluid line 50*b* and timing fluid drain line 58 need only be connected to the lubrication oil circuit instead of the fuel supply circuit as represent in FIG. 5 with the engine oil pump serving to supply lubrication oil to the tinting chamber when the solenoid valve 46 opens.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

Industrial Applicability

The present invention will find a wide range of applicability for small and midrange engines, especially diesel engines, requiring full electronic fuel control to reduce emissions and improve fuel consumption. Furthermore, it will be particularly attractive to those who also make or use engines having unit injector type fuel injection systems due to the opportunities for increased cost effectiveness.

We claim:

1. A pump-line-nozzle fuel injection system comprising an inline high pressure pump having a plurality of high pressure pumping cylinders, each of which comprises a plunger assembly reciprocatingly mounted within a cylinder bore, and a low pressure fuel supply pump connected to each cylinder of said inline high pressure pump; wherein each plunger assembly comprises a cam-driven tinting plunger and a floating metering plunger, a variable volume timing chamber being defined in said cylinder bore between an end of the timing plunger and a first end of the metering plunger, and a variable volume metering chamber being defined in said cylinder bore between a second end of the metering plunger and delivery valve at an outlet end of the respective cylinder; wherein said supply pump is connected to said metering chamber via a fuel supply branch of a fuel supply flow path from the supply pump containing a check valve in a manner enabling a flow of fuel to enter said metering chamber during an initial phase of a retraction stroke of the plunger assembly; wherein said timing chamber is connected to a supply of timing fluid via flow path containing a solenoid valve, said solenoid valve blocking timing fluid from flowing to said timing chamber during said initial phase of the retraction stroke of the plunger assembly; and wherein electronic control means is provided for opening said solenoid valve when a required amount of fuel has entered said metering chamber and for enabling timing fluid to flow into and out of said tinting chamber through said tinting fluid flow path, and for re-closing said solenoid valve during a compression stroke of the plunger assembly, so as to block said flow of timing fluid into and out of the timing chamber, for commencing compression of fuel in said metering chamber; and wherein said delivery valve is responsive to the pressure of fuel in said metering chamber for enabling delivery of fuel from the metering chamber to a respective fuel injector via a respective high pressure delivery line when the pressure of fuel in said metering chamber exceeds a predetermined value.

2. A pump-line-nozzle fuel injection system according to claim 1, wherein said timing fluid flow path is a branch of said fuel supply flow path by which fuel is supplied to said tinting chamber as said tinting fluid.

3. A pump-line-nozzle fuel injection system according to claim 2, wherein a spring acts between said end of the timing plunger and said first end of the metering plunger for maintaining sufficient positive pressure on fuel in said metering chamber to insure closure of said check valve when said solenoid valve is open during said retraction stroke.

4. A pump-line-nozzle fuel injection system according to claim 3, wherein said timing plunger has a larger diameter than said metering plunger.

5. A pump-line-nozzle fuel injection system according to claim 4, wherein the diameter of the timing plunger is approximately one-third larger than the diameter of the metering plunger.

6. A pump-line-nozzle fuel injection system according to claim 1, wherein said timing plunger has a larger diameter than said metering plunger.

7. A pump-line-nozzle fuel injection system according to claim 6, wherein the diameter of the timing plunger is approximately one-third larger than the diameter of the metering plunger.

8. A pump-line-nozzle fuel injection system according to claim 1, wherein first spill port means is provided for terminating injection of fuel from said metering chamber and draining fuel remaining in said metering chamber, and second spill port means for draining timing fluid from said timing chamber after injection of fuel from said metering chamber has been terminated.

9. A pump-line-nozzle fuel injection system according to claim 7, wherein the diameter of the timing plunger is approximately one-third larger than the diameter of the metering plunger.

10. A pump-line-nozzle fuel injection system according to claim 2, wherein pressure relief means is provided in said fuel supply flow path for diverting fuel from said fuel supply flow path to a drain flow path when said solenoid valve is open during said compression stroke of the plunger assembly and the pressure in said fuel supply flow path exceeds a predetermined value.

11. A pump-line-nozzle fuel injection system comprising a plurality of high pressure pumping cylinders, each of which comprises a plunger assembly reciprocatingly mounted within a cylinder bore, and a low pressure fuel supply pump connected to each cylinder; wherein each plunger assembly comprises a cam-driven timing plunger and a floating metering plunger, a variable volume timing chamber being defined in said cylinder bore between an end of the timing plunger and a first end of the metering plunger, and a variable volume metering chamber being defined in said cylinder bore between a second end of the metering plunger and delivery valve at an outlet end of the respective cylinder; wherein said supply pump is connected to said metering chamber via a fuel supply branch of a fuel supply flow path from the supply pump containing a check valve in a manner enabling a flow of fuel to enter said metering chamber during an initial phase of a retraction stroke of the plunger assembly; wherein said timing chamber is connected to a supply of tinting fluid via flow path containing a solenoid valve, said solenoid valve blocking tinning fluid from flowing to said timing chamber during said initial phase of the retraction stroke of the plunger assembly; and wherein electronic control means is provided for opening said solenoid valve when a required amount of fuel has entered said metering chamber and for enabling timing fluid to flow into and out of said timing chamber through said timing fluid flow path, and for re-closing said solenoid valve during a compression stroke of the plunger assembly, so as to block said flow of timing fluid into and out of the timing chamber, for commencing compression of fuel in said metering chamber; and wherein said delivery valve is responsive to the pressure of fuel in said metering chamber for enabling delivery of fuel to a respective fuel injector via a high pressure delivery line when the pressure of fuel in said metering chamber exceeds a predetermined value; wherein said timing fluid flow path comprises a line connected to an engine lubrication circuit by which lubricating oil is supplied to said timing chamber as said tinting fluid.

12. A pump-line-nozzle fuel injection system according to claim 11, wherein said tinting plunger has a larger diameter than said metering plunger.

13. A pump-line-nozzle fuel injection system according to claim 12, wherein the diameter of the timing plunger is approximately one-third larger than the diameter of the metering plunger.

14. A pump-line-nozzle fuel injection system according to claim 11, wherein first spill port means is provided for terminating injection of fuel from said metering chamber and draining fuel remaining in said metering chamber, and second spill port means for draining timing fluid from said timing chamber after injection of fuel from said metering chamber has been terminated.

15. A pump-line-nozzle fuel injection system according to claim 14, wherein the diameter of the timing plunger is approximately one-third larger than the diameter of the metering plunger.

16. A pump-line-nozzle fuel injection system according to claim 15, wherein the diameter of the timing plunger is approximately one-third larger than the diameter of the metering plunger.

* * * * *